US008323425B2

(12) United States Patent
Wang et al.

(10) Patent No.: US 8,323,425 B2
(45) Date of Patent: Dec. 4, 2012

(54) ARTIFICIAL AGING PROCESS FOR ALUMINUM ALLOYS

(75) Inventors: Qigui Wang, Rochester Hills, MI (US); Peggy E. Jones, Saginaw, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 930 days.

(21) Appl. No.: 12/042,639

(22) Filed: Mar. 5, 2008

(65) Prior Publication Data

US 2009/0223605 A1 Sep. 10, 2009

(51) Int. Cl.

| | |
|---|---|
| ***C21D 11/00*** | (2006.01) |
| ***C22C 21/00*** | (2006.01) |
| ***C22F 1/04*** | (2006.01) |

(52) U.S. Cl. ..... 148/502; 148/415; 148/698

(58) Field of Classification Search ..... 148/502, 148/698, 415

See application file for complete search history.

(56) References Cited

U.S. PATENT DOCUMENTS

| | | | |
|---|---|---|---|
| 3,645,804 | A | 2/1972 | Ponchel |
| 6,972,110 | B2 | 12/2005 | Chakrabarti et al. |
| 7,018,489 | B2 | 3/2006 | Bennon et al. |

FOREIGN PATENT DOCUMENTS

| | | | |
|---|---|---|---|
| CA | 1047901 | A1 | 2/1979 |
| CN | 1434877 | | 8/2003 |
| DE | 2446828 | A1 | 4/1975 |
| DE | 266849 | A1 | 4/1989 |
| WO | 01/48259 | A1 | 7/2001 |
| WO | 2007/106772 | A2 | 9/2007 |

OTHER PUBLICATIONS

Myhr et al., "Modelling of Non-Isothermal Transformations in Alloys Containing a Particle Distribution", 2000, Acta Materialia, 48, p. 1605-1615.*

Myhr et al., "Modelling of the Age Hardening Behavious of Al-Mg-Si Alloys", 2001, Acta Materialia, 49, 65-75.*

A. Deschamps, et al., Influence of Predeformation and Ageing of an A1-Zn-Mg Alloy-Il. Modeling of Precipitation Kinetics and Yield Stress, Acta mater. vol. 47, No. 1, pp. 293-305, 1999.

* cited by examiner

*Primary Examiner* — Roy King
*Assistant Examiner* — Caitlin Kiechle
(74) *Attorney, Agent, or Firm* — Dinsmore & Shohl LLP

(57) ABSTRACT

Embodiments of a method for non-isothermally aging an aluminum alloy are provided. The method comprises heating an aluminum alloy at a first ramp-up rate to a maximum temperature below a precipitate solvus value, cooling the alloy at a first cooling rate sufficient to produce a maximum number of primary precipitates, cooling at a second cooling rate until a minimum temperature is reached wherein the growth rate of primary precipitates is equal to or substantially zero, and heating the alloy at a second ramp-up rate to a temperature sufficient to produce a maximum number of secondary precipitates.

15 Claims, 4 Drawing Sheets

ARTIFICIAL AGING PROCESS FOR ALUMINUM ALLOYS

TECHNICAL FIELD

Embodiments of the present invention are related to methods of optimizing a non-isothermal artificial aging scheme to achieve target material properties with minimum energy use and lead time.

SUMMARY

Heat treatment, in particular aging (or precipitation) hardening is an important step to achieve the desired strength of engineering materials, such as cast aluminum alloys A356/357 or the like. Strengthening by aging hardening is applicable to alloys in which the solid solubility of at least one alloying element decreases with decreasing temperature. Some wrought and cast aluminum alloys are age-hardenable, such as 6xxx, 7xxx, 3xx, or the like. The present invention extends to all such aluminum alloys made by various manufacturing processes including, but not limited to forging, casting, and powder metallurgy.

Conventional heat treatment of age-hardenable aluminum alloys normally involves three stages: (1) solution treatment of the products or components at a relatively high temperature, for example, a temperature just below the melting temperature of the alloy; (2) rapid cooling (or quenching) in a cold media such as water at room-temperature or a designed temperature; and (3) aging the materials by holding them for a period of time at room temperature (natural aging) or at an intermediate temperature (artificial aging). Solution treatment serves three main purposes: (1) dissolution of elements that will later cause age hardening, (2) spherodization of undissolved constituents, and (3) homogenization of solute concentrations in the material.

Quenching is used to retain the solute elements in a supersaturated solid solution (SSS) and also to create a supersaturation of vacancies that enhance the diffusion and the dispersion of precipitates. To maximize strength of the alloy, the precipitation of all strengthening phases should be prevented during quenching. Aging (either natural or artificial) creates a controlled dispersion of strengthening precipitates. FIG. 1 shows a typical heat treatment cycle of A356 cast aluminum alloys. In practice, aluminum components such as cast aluminum products (engine blocks and cylinder heads) usually have different wall thicknesses varying from a few millimeters to a few centimeters. Due to the conventional isothermal aging process, this leads to nonuniformities in temperature profile and yield strength between thin and thick sections of the aluminum product.

In the present invention, a non-isothermal aging process has been developed based on precipitation strengthening and computational thermodynamic and kinetics. The aging temperature varies with time so that the concomitant nucleation, growth and coarsening of precipitates can be controlled and optimized. With the non-isothermal aging scheme, the desired yield strength of aluminum alloys can be achieved with minimal time and energy. Also, uniform yield strength can be achieved across the whole component by altering the heating/cooling scheme during the aging process. Higher yield strength can be realized in the improved (non-isothermal) aging process, while minimizing aging time and energy input.

According to one embodiment of the present invention, a method for non-isothermally aging an aluminum alloy is provided. The method comprises the steps of: heating an aluminum alloy at a first ramp-up rate to a maximum temperature below a precipitate solvus value, cooling the alloy at a first cooling rate sufficient to produce a maximum number of primary precipitates, cooling at a second cooling rate until a minimum temperature is reached wherein the growth rate of primary precipitates is equal to or substantially zero, and heating the alloy at a second ramp-up rate to a temperature sufficient to produce a maximum number of secondary precipitates.

These and additional features provided by the embodiments of the present invention will be more fully understood in view of the following detailed description, in conjunction with the drawings.

BRIEF DESCRIPTION OF THE DRAWINGS

The following detailed description of specific embodiments of the present invention can be best understood when read in conjunction with the drawings enclosed herewith. The drawing sheets include.

Figure 1:
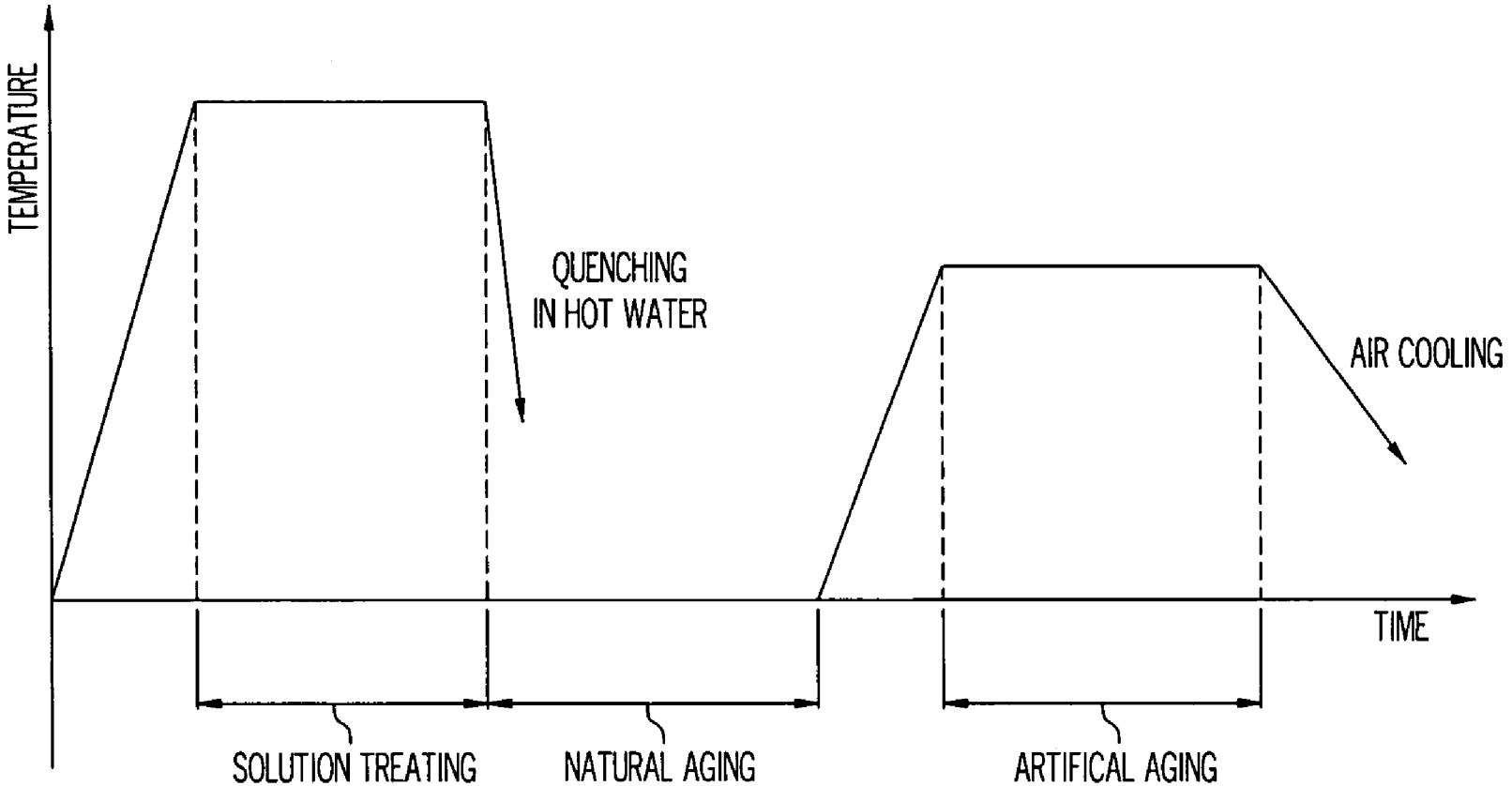
FIG. 1 (PRIOR ART)
FIG. 1 (Prior Art) is a graphical illustration of the conventional isothermal aging process.

The embodiments set forth in the drawings are illustrative in nature and not intended to be limiting of the invention defined by the claims. Moreover, individual features of the drawings and the invention will be more fully apparent and understood in view of the detailed description.

DETAILED DESCRIPTION

This invention is directed to achieving the maximum precipitate hardening for a given alloy (with a given amount of hardening elements in the matrix) using minimum energy and time through a non-isothermal aging. The maximum aging hardening is obtained by producing an ideal precipitate structure comprised of uniformly distributed precipitates which have optimal size, shape and spacing. The size, shape and spacing is a function of aging temperature, time and concentration of hardening elements at any given aging time and temperature.

Desirable tensile properties for cast aluminum alloys include yield strength and ultimate tensile strength. The ultimate tensile strength is not an independent variable and it varies with yield strength and ductility. Maximizing the yield strength is highly dependent upon precipitate hardening. The non-isothermal aging process of this invention is directed to achieving this maximized yield strength with minimum energy, and minimum aging time, while also achieving a more uniform distribution of yield strengths across the whole aluminum alloy component or product.

To achieve these properties, the present inventors have devised a model where the age hardening process of aluminum alloys includes formation of Guinier Preston (GP) zones, coherent and incoherent precipitates, which is in correspondence to nucleation, growth and coarsening of precipitates.

The contribution to the yield strength from precipitation hardening, $\Delta\sigma_{ppt}$ is related to the microstructural (precipitate) variables:

$$\Delta\sigma_{ppt}=f(d_{eq},l,f_v,S,F) \tag{1}$$

where $d_{eq}$ is the average equivalent circle diameter, $f_v$ is the volume fraction of precipitates, F is the maximum interaction force between an average size precipitate and dislocation, S is a microstructural variable representing the shape and orientation relationship of the precipitate with the matrix and dislocation line, l is the average spacing between precipitates which are acting as obstacles to dislocation motion.

The microstructural variables mentioned above are functions of aging temperature, aging time, and solute concentrations. The contribution to yield strength from the precipitation hardening is then a function of aging temperature, aging time, and hardening solute concentration:

$$\Delta\sigma_{ppt} = A\int_0^{Tc}\int_0^{\infty}\int_0^{c_0} f(T,t,C)\,dc\,dt\,dT \tag{2}$$

where A is a constant, f(T,t,C) is the strengthening factor, C is the hardening solute concentration, and Tc is the maximum feasible aging temperature.

Figure 3:
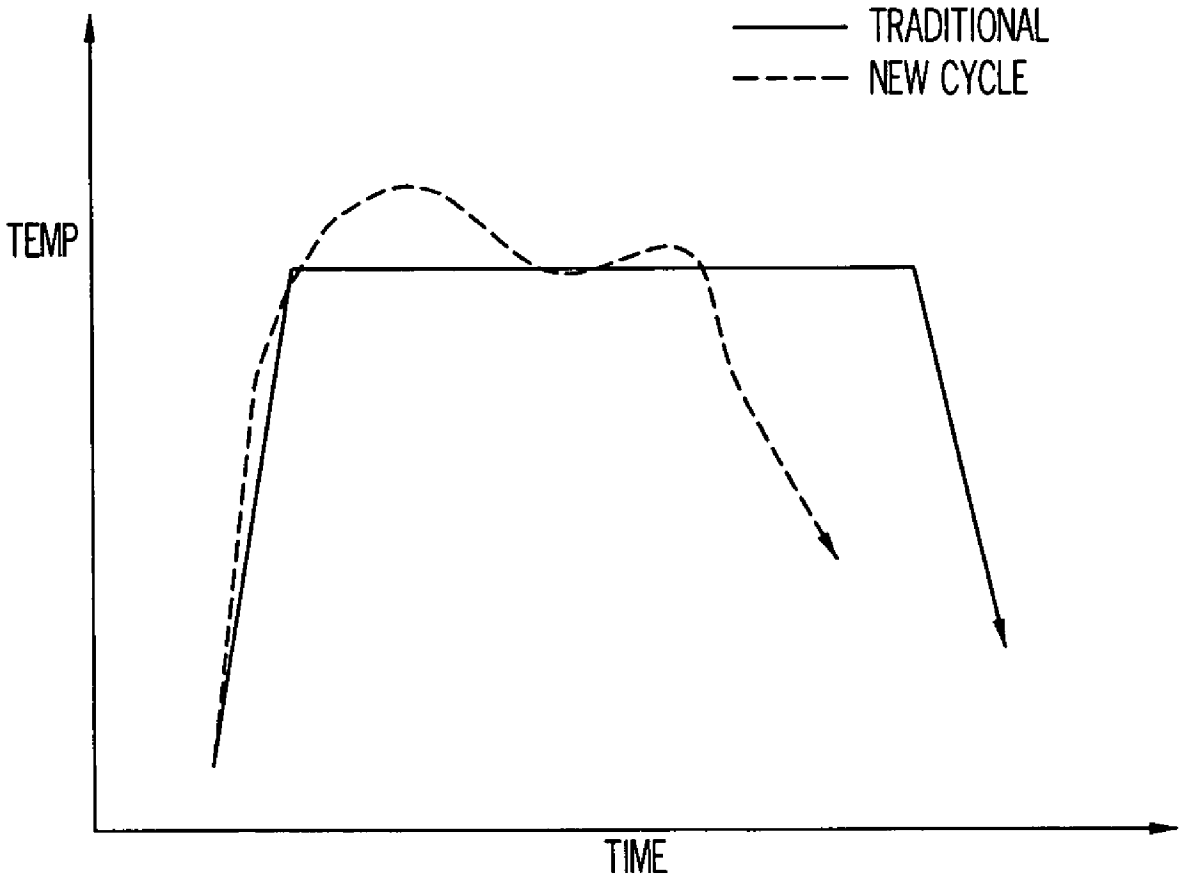
FIG. 3 is a graphical illustration comparing the aging cycles of a conventional isothermal aging process and an embodiment of the non-isothermal aging process according to one or more embodiments of the present invention.

For a SSS of an aluminum alloy, the age hardening process includes concomitant nucleation, growth, and coarsening of precipitates. For a given hardening solute concentration, concomitant nucleation, growth, and coarsening are merely sensitive to temperature and time. The competition among the three processes can be manipulated to give significant enhancements in strength through the use of a carefully controlled non-isothermal aging treatment scheme, T(t), as shown in FIG. 3.

In addition, the non-isothermal scheme T(t) for an aluminum alloy can be optimized to achieve the desired yield and tensile strengths with minimum energy input and aging time. This multi-objective problem with constraints can be defined as:

$$\begin{cases} \underset{(T,t)\in\Omega}{\text{Min}}\, E(T,t) = \underset{(T,t)\in\Omega}{\text{Min}} \oint T(t)\,dt \\ \underset{(T,t)\in\Omega}{\text{Max}}\, \Delta\sigma_{ppt}(T,t,C) \end{cases} \tag{3}$$

$$\Omega = \{0 < T < T_c;\ 0 < t < \infty;\ 0 < C < C_0\}$$

$$\Delta\sigma_{ppt}(T,t,C) \geq \Delta\sigma_{target}$$

where E(T,t) is the energy input, which is the function of temperature and time.

In this innovative aging process, the aging scheme (cycle) is determined by a precipitation strengthening model coupled with computational thermodynamics and kinetics. For a SSS of an aluminum alloy, the model simultaneously simulates the precipitation processes including concomitant nucleation, growth, and coarsening. It therefore describes the transition between shearing and bypassing of precipitates, which controls the peak strength of the materials at a given aging temperature. The model assumes that the precipitates are homogeneously distributed in the microstructure with a spatial size distribution and that the dislocation line has to pass through all the obstacles (precipitates) which are encountered in the slip plane in order to cause macroscopic strain. According to dislocation strengthening theory, the strength increase due to precipitates in the alloy can be calculated by:

$$\Delta\sigma_{ppt} = \frac{M}{b}\frac{\int_0^{\infty} f(r_{eq})F(r_{eq})\,dr_{eq}}{\int_0^{\infty} f(l)\,dl} \tag{4}$$

where $\Delta\sigma_{ppt}$ is the strength increase due to precipitate shearing and bypassing, M is the Taylor factor; b is the Burgers vector; $r_{eq}$ and l are precipitate equivalent circle radius ($r_{eq}$=0.5 $d_{eq}$) and spacing on the dislocation line, respectively; $f(r_{eq})$ is the precipitate size distribution; f(l) is the particle spacing distribution; and $F(r_{eq})$ is the obstacle strength of a precipitate of radius $r_{eq}$.

The Burgers vector, often denoted by b, is a vector that represents the magnitude and direction of the lattice distortion of dislocation in a crystal lattice. The vector b is equal to $2.86\times10^{-10}$ m for an aluminum alloy.

Assuming solute concentrations are constant as stated above, only two length scales (l and $r_{eq}$) of precipitate distribution affect the materials strength. These two length scales are related to the age hardening process and are functions of aging temperature (T) and aging time (t). Therefore, Eqns. (4) can be rewritten to a general form.

$$\Delta\sigma_{ppt} = \frac{M}{b}\int_0^{Tc}\int_0^{\infty} f(T,t)\,dt\,dT \tag{5}$$

The two length scales of precipitate distribution (l and $r_{eq}$) can be obtained empirically from experimental measurements or by computational thermodynamics and kinetics. In the present invention, the model is theoretically based on the fundamental nucleation and growth theories. The driving force (per mole of solute atom) for precipitation is calculated using:

$$\Delta G = \frac{RT}{V_{atom}}\left[C_p\ln\left(\frac{C_0}{C_{eq}}\right) + (1-C_p)\ln\left(\frac{1-C_0}{1-C_{eq}}\right)\right] \tag{6}$$

where $V_{atom}$ is the atomic volume ($m^3\ mol^{-1}$), R is the universal gas constant (8.314 J/K mol), T is the temperature (K), $C_0$, $C_{eq}$, and $C_p$ are mean solute concentrations by atom percentage in matrix, equilibrium precipitate-matrix interface, and precipitates, respectively. From the driving force, a critical radius $r_{eq}$* is derived for the precipitates at a given matrix concentration C:

$$r_{eq}^* = \frac{2\gamma V_{atom}}{\Delta G} \tag{7}$$

where γ is the particle/matrix interfacial energy.

The variation of the precipitate density (number of precipitates per unit volume) is given by the nucleation rate. The evolution of the mean precipitate size (radius) is given by the combination of the growth of existing precipitates and the addition of new precipitates at the critical nucleation radius $r_{eq}$*. The nucleation rate is calculated using a standard Becker-Döring law:

$$\left.\frac{dN}{dt}\right|_{nucleation} = N_0 Z\beta * \exp\left(-\frac{4\pi r_0^2\gamma}{3RT\ln^2(C/C_{eq})}\right)\exp\left(-\frac{1}{2\beta * Zt}\right) \quad (8)$$

where N is the precipitate density (number of precipitates per unit volume), $N_0$ is the number of atoms per unit volume ($=1/V_{atom}$), Z is Zeldovich's factor (≈½0). The evolution of the precipitate size is calculated by:

$$\frac{dr_{eq}}{dt} = \frac{D}{r_{eq}}\frac{C - C_{eq}\exp(r_0/r_{eq})}{1 - C_{eq}\exp(r_0/r_{eq})} + \frac{1}{N}\frac{dN}{dt}\left(\alpha\frac{r_0}{\ln(C/C_{eq})} - r_{eq}\right) \quad (9)$$

where D is the diffusion coefficient of solute atom in solvent.

In the late stages of precipitation, the precipitates continue growing and coarsening, while the nucleation rate decreases significantly due to the desaturation of solid solution. When the mean precipitate size is much larger than the critical radius, it is valid to consider growth only. When the mean radius and the critical radius are equal, the conditions for the standard Lifshitz-Slyozov-Wagner (LSW) law are fulfilled. Under the LSW law, the radius of a growing particle is a function of $t^{1/3}$ (t is the time). The precipitate radius can be calculated by:

$$r_{eq}^3 - r_o^3 = \frac{8}{9}\frac{DC_o\gamma V_{atom}^2 t}{RT} \quad (10)$$

Several assumptions are made in calculating the particle spacing along the dislocation line. First, a steady state number of precipitates along the moving dislocation line is assumed, following Friedel's statistics for low obstacle strengths. After assuming a steady state number of precipitates, the precipitate spacing is then given by the calculation of the dislocation curvature under the applied resolved shear stress, τ on the slip plane:

$$l = \left(\frac{4\pi}{3f_v}\frac{\overline{r_{eq}^2}\Gamma}{b\tau}\right)^{1/3} \quad (11)$$

where $f_v$ is the volume fraction of precipitates and $\overline{r_{eq}}$ is the average radius of precipitates. Γ is the line tension ($=\beta\mu b^2$, where β is a parameter close to ½).

The volume fraction of precipitates ($f_v$) can be determined experimentally by Transmission Electron Microscopy (TEM) or the Hierarchical Hybrid Control (HHC) model. In the HHC model, the volume fraction of precipitates can be calculated:

$$f_v = \frac{2\pi r_{eq}^3}{\alpha}A_0 N_0 Z\beta^*\exp\left(\frac{-\Delta G^*}{RT}\right)t \quad (12)$$

where α is the aspect ratio of precipitates, $A_0$ is the Avogadro number, ΔG* is the critical activation energy for precipitation, the parameter of β* is obtained by $$\beta^* = 4\pi(r_{eq}^*)DC_0/a^4 \quad (13)$$

where a is the lattice parameter of precipitate.

In computational thermodynamics approaches, a commercially available aluminum database, for instance Pandat®, is employed to calculate precipitate equilibriums, such as β phase in Al—Si—Mg alloy and θ phase in Al—Si—Mg—Cu alloy. The equilibrium phase fractions, or the atomic % solute in the hardening phases are parameterized from computational thermodynamics calculations. The equilibrium phase fractions are dependent upon temperature and solute concentration, but independent of aging time ($f_i^{eq}$ (T,C)).

Many metastable precipitate phases, such as β", β' in Al—Si—Mg alloy and θ' in Al—Si—Mg—Cu alloy are absent from the existing computational thermodynamics database. The computational thermodynamics calculations alone cannot deliver the values of metastable phase fractions. In this case, the density-functional based first-principles methods are adopted to produce some properties such as energetics, which are needed by computational thermodynamics. Density functional theory (DFT) is a quantum mechanical theory commonly used in physics and chemistry to investigate the ground state of many-body systems, in particular atoms, molecules and the condensed phases. The main idea of DFT is to describe an interacting system of fermions via its density and not via its many-body wave function. First-principles methods, also based on quantum-mechanical electronic structure theory of solids, produce properties such as energetics without reference to any experimental data. The free energies of metastable phases can be described by a simple linear functional form:

$$\Delta G_i(T) = c_1 + c_2 T \quad (14)$$

where $c_1$ and $c_2$ are coefficients. $c_1$ is equivalent to enthalpies of formation of metastable phases at absolute zero temperature (T=0 K). By replacing the unknown parameter $c_1$ in Eqn. 14 with the formation enthalpy at T=0 K from first-principles, the free energy can be rewritten as $$\Delta G_i(T) = \Delta H_i(T=0\text{K}) + c_2 T \quad (15)$$

The other unknown parameter $c_2$ can then be determined simply by fitting the free energies of liquid and solid to be equal at the melting point.

After calculating the strength increase due to precipitation hardening ($\Delta\sigma_{ppt}$), the yield strength of aluminum alloys can be simply calculated by adding it to the intrinsic strength ($\sigma_i$) and the solid-solution strength of the material:

$$\sigma_{ys} = \sigma_i + \sigma_{ss} + \Delta\sigma_{ppt} \quad (16)$$

The solid solution contribution to the yield strength is calculated as:

$$\sigma_{ss} = KC_{GP/ss}^{2/3} \quad (17)$$

where K is a constant and $C_{GP/ss}$ is the concentration of strengthening solute that is not in the precipitates. The intrinsic strength ($\sigma_i$) includes various strengthening effects such as grain/cell boundaries, the eutectic particles (in cast aluminum alloys), the aluminum matrix, and solid-solution strengthening due to alloying elements other than elements in precipitates.

This aging profile may be customized for various alloys with varying temperature profiles. In one embodiment, the non-isothermal aging process may include the step of heating an aluminum alloy at a first ramp-up rate to a maximum temperature below the precipitate solvus. By selecting a maximum temperature just below the precipitate solvus, the number of stable primary precipitate nuclei is maximized. As used herein, the precipitate solvus is the limit of solubility for a homogeneous solid solution before it will be degraded through melting, etc. The precipitate solvus temperature can be either measured or calculated. In an A356 alloy (7% Si and 0.4% Mg), the solvus temperature for the β" precipitates is about 280° C. The first ramp-up rate may be the maximum possible heating rate. In one exemplary embodiment, the first ramp-up rate may be up to about 100° C./s.

Figure 2:
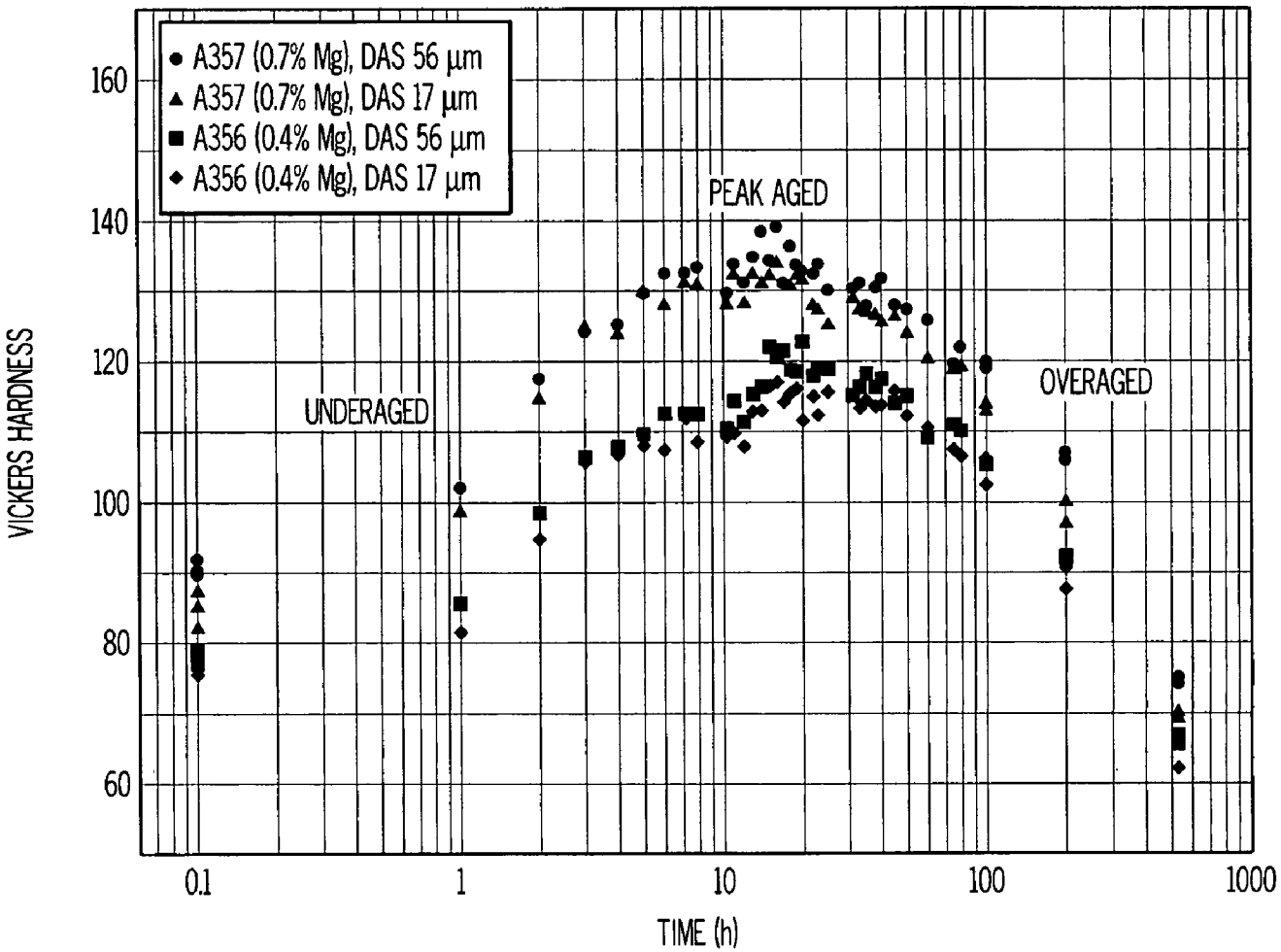
FIG. 2 is a graphical illustration of the aging response of cast aluminum alloys (A356/A357) aged at 170° C.

After the maximum temperature is reached, the alloy may be cooled at a first cooling rate sufficient to produce a maximum number of primary precipitates. The primary precipitates may be arranged in a homogenous volumetric distribution in simple or complex shaped components. Complex shaped components may include but are not limited to engine blocks or cylinder heads. Primary precipitates are typically those grown in the alloy in the underaged or peak aged stages as shown in FIG. 2. The first cooling rate may be obtained utilizing various equations familiar to one of ordinary skill in the art. In one embodiment, the first cooling rate may be obtained by optimizing precipitation growth rate $$\frac{dr_{eq}}{dt}$$

and nucleation rate $$\frac{dN}{dt}$$

using equations such as 8 and 9 shown below:

$$\frac{dN}{dt}\Big|_{nucleation} = N_0 Z\beta^* \exp\left(-\frac{4\pi r_0^2\gamma}{3RT\ln^2(C/C_{eq})}\right)\exp\left(-\frac{1}{2\beta^* Zt}\right)$$

and $$\frac{dr_{eq}}{dt} = \frac{D}{r_{eq}}\frac{C - C_{eq}\exp(r_0/r_{eq})}{1 - C_{eq}\exp(r_0/r_{eq})} + \frac{1}{N}\frac{dN}{dt}\left(\alpha\frac{r_0}{\ln(C/C_{eq})} - r_{eq}\right)$$

The optimization is characterized by the maximization of $$\frac{dN}{dt}$$

and the minimization of $$\frac{dr_{eq}}{dt}.$$

The optimization of these variables and equations may be conducted via an optimization algorithm familiar to one of ordinary skill in the art, for example, a computerized algorithm or iterative algorithm.

Subsequently, the alloy is cooled at a more rapid second cooling rate until a minimum temperature is reached wherein the growth rate of existing precipitates is at or close to zero. The second cooling rate is typically designed to lower the temperature as quickly as possible within practical equipment limits. Many methods of calculating the second cooling rate are contemplated herein. In one embodiment, minimum temperature may be obtained by via equations 8 and 9. At the minimum temperature, the precipitation growth rate $$\frac{dr_{eq}}{dt}$$

is at or approaching zero, thus $$\frac{dr_{eq}}{dt}$$

in equations 8 and 9 is set to zero and the minimum temperature may be solved.

After the minimum temperature is achieved, the alloy is heated at a second ramp-up rate to a temperature sufficient to produce a maximum number of homogeneously distributed secondary precipitates. Secondary precipitates may occur in the overaged stage as shown in FIG. 2. The second ramp-up rate is obtained by optimizing the precipitation growth rate and the nucleation rate using equations such as 8 and 9, while adjusting for the composition change due to the formation of the primary precipitates. The optimization is characterized by the maximization of $$\frac{dN}{dt} \text{ and } \frac{dr_{eq}}{dt}.$$

The second ramp-up rate is configured to minimize the growth rate and nucleate as many secondary precipitates as possible.

Additionally, equations 10 through 15 may be optimized to ensure that the final temperature and second ramp-up rate are controlled to yield the highest number density of secondary precipitates. The final temperature and second ramp-up rate are further optimized for the energy minimization and target strength, wherein the target strength constraint helps prevent coarsening the primary precipitates while producing the secondary precipitates. The strength, which may be calculated with equation 16, depends on the number and sizes of precipitate particles, in addition to how closely spaced the particles are.

Figure 4:
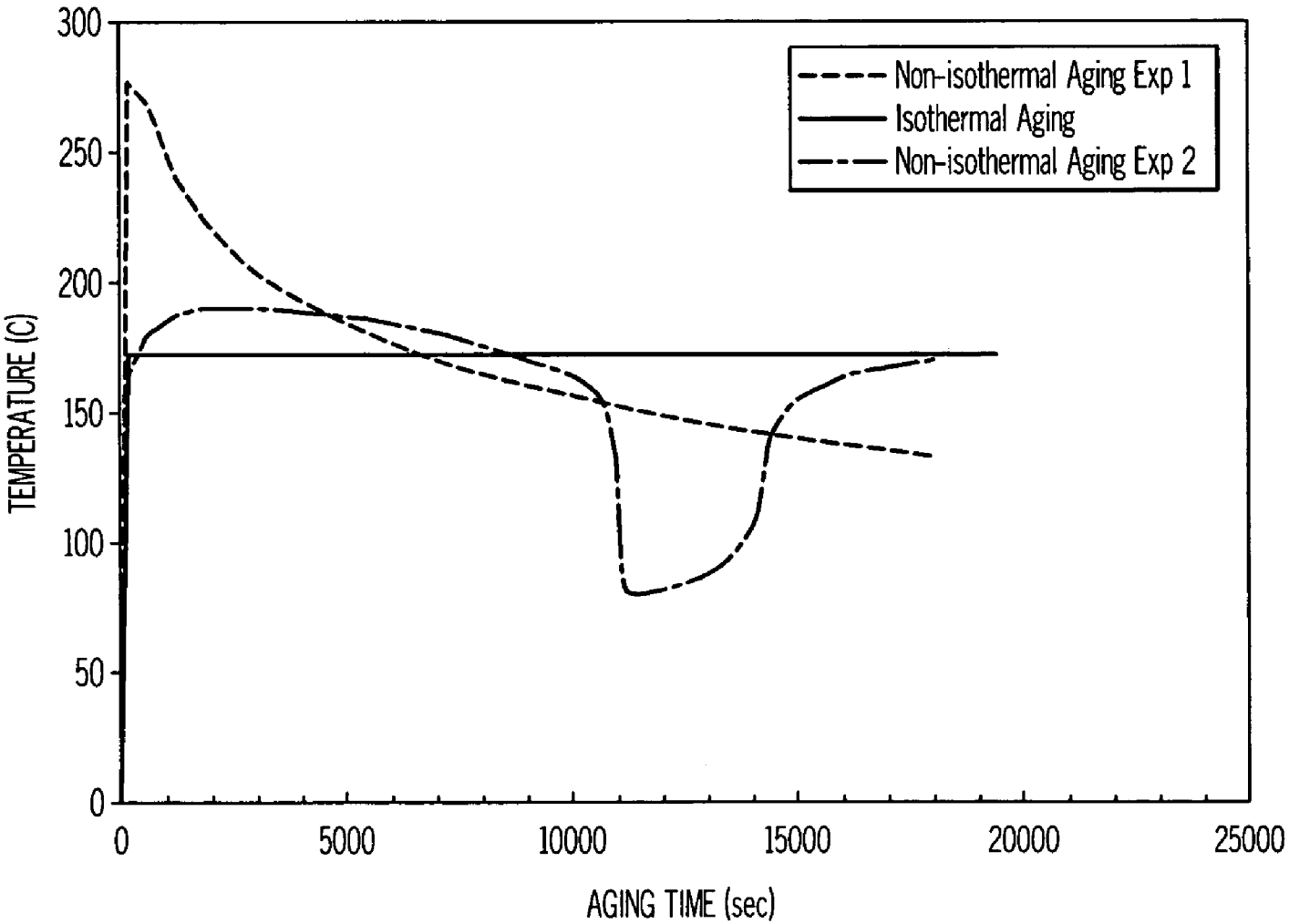
FIG. 4 is a comparison of the aging cycles between a conventional isothermal aging process and two embodiments of a non-isothermal aging process according to one or more embodiments of the present invention.

As shown in Exp. 1 of FIG. 4, embodiments of the present invention may also be directed to a process of achieving a target strength with lower energy using a single step process to optimize primary precipitates. This may be achieved by controlling the cooling rate alone, without utilizing a secondary precipitate control step.

Using equation 4 above, the maximum tensile strength increase due to precipitation $\Delta\sigma_{ppt}$ may be calculated. In one embodiment, the aging process yields a tensile strength of about 250 to about 300 MPa, and requires from about 750 to about 800° C.*hr (energy index) in energy input over 5 hours.

The energy index is derived as follows. Assuming that the surface area of the furnace is A ($m^2$) and the wall thickness of the furnace is L (m). The heat flux of energy lost (input) through heat conduction at a given time is:

$$H = k \cdot \frac{A}{L}(T(t) - T_{air})$$

where k is the thermal conductivity of the wall material in the furnace. T(t) and $T_{air}$ are temperatures of furnace and air, respectively.

For a period of time (t), the energy loss (input) is then:

$$Q = \int_0^t H dt = k\frac{A}{L}\int_o^t (T(t) - T_{air})dt = k\frac{A}{L}Q_I$$

$$Q_I = \int_o^t (T(t) - T_{air})dt$$

where $Q_I$ is the energy index (unit: ° C.*hr), which is the integration of aging temperature over the entire aging time.

Referring to FIG. 4 and Table 1 below, the non-isothermal aging Exp. 1 and 2 were compared with a conventional isothermal aging cycle. For comparison, a conventional isothermal aging cycle is assumed at 170° C. (or 443° K) for 5.4 hrs. The total aging time in non-isothermal Exp. 1 is 5 hrs. In comparison with the conventional isothermal aging (170° C. for 5.4 hrs), the non-isothermal aging Exp. 2 provides reduced energy input (saving ~15%), reduced aging time, while achieving increased yield strength (increased ~10%).

TABLE 1

| Aging cycle | Temperature (° C.) | Aging time (hrs) | Energy Input Index (° C. × hr) | Yield strength (MPa) Measured | Yield strength (MPa) Predicted |
|---|---|---|---|---|---|
| Conventional isothermal aging | 170 | 5.4 | 918 | 252 | 249 |
| Non-isothermal aging Exp 1 | vary | 5 | 852 | 204 | 211 |
| Non-isothermal aging Exp 2 | vary | 5 | 792 | 278 | 275 |

For the purposes of describing and defining the present invention it is noted that the terms "substantially" and "about" are utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A method for non-isothermally aging an aluminum alloy comprising:

heating an aluminum alloy at a first ramp-up rate to a maximum temperature below a precipitate solvus;

when the aluminum alloy reaches the maximum temperature, cooling the alloy at a first cooling rate sufficient to produce a maximum number of primary precipitates wherein the first cooling rate is obtained by optimizing a precipitation growth rate $$\frac{dr_{eq}}{dt}$$

and a nucleation rate $$\frac{dN}{dt}$$

using the following two equations:

$$\frac{dN}{dt}\Big|_{nucleation} = N_0 Z\beta^* \exp\left(-\frac{4\pi r_0^2\gamma}{3RT\ln^2(C/C_{eq})}\right)\exp\left(-\frac{1}{2\beta^* Zt}\right)$$

and $$\frac{dr_{eq}}{dt} = \frac{D}{r_{eq}}\frac{C - C_{eq}\exp(r_0/r_{eq})}{1 - C_{eq}\exp(r_0/r_{eq})} + \frac{1}{N}\frac{dN}{dt}\left(\alpha\frac{r_0}{\ln(C/C_{eq})} - r_{eq}\right),$$

where N is the precipitate density number (number of precipitates per unit volume), $N_0$ is the number of atoms per unit volume ($=1/V_{atom}$), Z is Zeldovich's factor, $$\frac{dr_{eq}}{dt}$$

is the precipitation growth rate, D is the diffusion constant, $r_{eq}$ is the precipitate radius (also called precipitate size), $r_0$ is the value of $$\frac{2\gamma V_{atom}}{RT},$$

$C_0$ is the mean solute concentration by atom percentage in the alloy matrix, $C_{eq}$ is the mean solute concentration by atom percentage in equilibrium precipitate-matrix interface, and α is the aspect ratio of precipitates, wherein the optimization is characterized by the maximization of $$\frac{dN}{dt}$$

and the minimization of $$\frac{dr_{eq}}{dt};$$

after cooling the alloy at the first cooling rate, cooling the alloy at a second cooling rate until a minimum temperature is reached wherein the growth rate of primary precipitates is equal to or substantially zero, the second cooling rate being higher than the first cooling rate; and when the minimum temperature is reached, heating the alloy at a second ramp-up rate to a temperature sufficient to produce a maximum number of secondary precipitates;

the first ramp-up rate, the first cooling rate, the second cooling rate, and the second ramp-up rate causing non-isothermal aging in which an aging temperature varies continuously with time.

2. The method of claim 1 wherein the primary precipitates and the secondary precipitates are homogeneously distributed.

3. The method of claim 1 wherein the alloy is present in a complex shaped component.

4. The method of claim 3 wherein the complex shaped component is an engine block or cylinder head.

5. The method of claim 1 wherein the first ramp-up rate is the maximum achievable heating rate.

6. The method of claim 1 wherein the first ramp-up rate is up to about 100° C./s.

7. The method of claim 1 wherein the second cooling rate is the maximum achievable cooling rate.

8. The method of claim 1 wherein the minimum temperature is obtained by the equation $$\frac{dr_{eq}}{dt} = \frac{D}{r_{eq}}\frac{C - C_{eq}\exp(r_0/r_{eq})}{1 - C_{eq}\exp(r_0/r_{eq})} + \frac{1}{N}\frac{dN}{dt}\left(\alpha\frac{r_0}{\ln(C/C_{eq})} - r_{eq}\right),$$

where $$\frac{dr_{eq}}{dt}$$

is the precipitation growth rate, D is the diffusion constant, $r_{eq}$ is the precipitate radius (also called precipitate size), $r_0$ is the value of $$\frac{2\gamma V_{atom}}{RT},$$

$C_0$ is the mean solute concentration by atom percentage in the alloy matrix, $C_{eq}$ is the mean solute concentration by atom percentage in equilibrium precipitate-matrix interface, and $\alpha$ is the aspect ratio of precipitates, wherein $$\frac{dr_{eq}}{dt} = 0$$

at the minimum temperature.

9. The method of claim 1 wherein the second ramp-up rate is obtained by optimizing the precipitation growth rate and the nucleation rate using the following two equations:

$$\left.\frac{dN}{dt}\right|_{nucleation} = N_0 Z\beta^* \exp\left(-\frac{4\pi r_0^2\gamma}{3RT\ln^2(C/C_{eq})}\right)\exp\left(-\frac{1}{2\beta^* Zt}\right)$$

and $$\frac{dr_{eq}}{dt} = \frac{D}{r_{eq}}\frac{C - C_{eq}\exp(r_0/r_{eq})}{1 - C_{eq}\exp(r_0/r_{eq})} + \frac{1}{N}\frac{dN}{dt}\left(\alpha\frac{r_0}{\ln(C/C_{eq})} - r_{eq}\right),$$

where N is the precipitate density (number of precipitates per unit volume), $N_0$ is the number of atoms per unit volume ($=1/V_{atom}$), Z is Zeldovich's factor, $$\frac{dr_{eq}}{dt}$$

is the precipitation growth rate, D is the diffusion constant, $r_{eq}$ is the precipitate radius (also called precipitate size), $r_0$ is the value of $$\frac{2\gamma V_{atom}}{RT},$$

$C_0$ is the mean solute concentration by atom percentage in the alloy matrix, $C_{eq}$ is the mean solute concentration by atom percentage in equilibrium precipitate-matrix interface, and $\alpha$ is the aspect ratio of precipitates, wherein the optimization is characterized by the maximization of $$\frac{dN}{dt} \text{ and } \frac{dr_{eq}}{dt}.$$

10. The method of claim 1 wherein the aging achieves a maximum tensile strength increase due to precipitation $\Delta\sigma_{ppt}$ according to the equation $$\Delta\sigma_{ppt} = \frac{M}{b}\frac{\int_0^\infty f(r_{eq})F(r_{eq})dr_{eq}}{\int_0^\infty f(l)dl}$$

where M is the Taylor factor, b is the Burgers vector, $r_{eq}$ is the precipitate radius (also called precipitate size), l is the spacing on the dislocation line, $f(r_{eq})$ is the precipitate size distribution, f(l) is the particle spacing distribution, and $F(r_{eq})$ is the obstacle strength of a precipitate of radius $r_{eq}$.

11. The method of claim 10 wherein l is equal to $$l = \left(\frac{4\pi}{3f_v}\frac{\overline{r_{eq}^2}\Gamma}{b\tau}\right)^{1/3},$$

where $f_v$ is the volume fraction of precipitates and $\overline{r_{eq}}$ is the average radius of precipitates, $\Gamma$ is the line tension.

12. The method of claim 11 where $$f_v = \frac{2\pi r_{eq}^3}{\alpha} A_0 N_0 Z \beta^* \exp\left(\frac{-\Delta G^*}{RT}\right) t$$

and $\beta^* = 4\pi(r^*_{eq})^2 DC_0/a^4$.

13. The method of claim 11 wherein the line tension is $\beta\mu b^2$, where $\beta$ is approximately ½.

14. The method of claim 10 wherein $r_{eq}$ is defined by the equation $$r_{eq}^3 - r_o^3 = \frac{8}{9} \frac{DC_o \gamma V_{atom}^2 t}{RT}$$

when the mean precipitate size is much larger than critical radius $r_{eq^*}$.

15. A method for producing an aluminum alloy comprising:

solution treating the alloy at temperatures below the melting point of the alloy;

quenching the solution treated alloy; and aging the quenched alloy according to the method of claim 1.

* * * * *